US010704009B2

(12) United States Patent
Miller et al.

(10) Patent No.: US 10,704,009 B2
(45) Date of Patent: Jul. 7, 2020

(54) ULTRA LOW ASH LUBRICATING OIL COMPOSITIONS

(71) Applicant: Chevron Oronite Company LLC, San Ramon, CA (US)

(72) Inventors: John Robert Miller, San Rafael, CA (US); Kevin David Carabell, Fairfax, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 15/875,269

(22) Filed: Jan. 19, 2018

(65) Prior Publication Data

US 2019/0225909 A1 Jul. 25, 2019

(51) Int. Cl.
*C10M 169/04* (2006.01)
*C10M 141/12* (2006.01)

(52) U.S. Cl.
CPC ..... *C10M 169/04* (2013.01); *C10M 141/12* (2013.01); *C10M 2201/087* (2013.01); *C10M 2203/1025* (2013.01); *C10M 2207/026* (2013.01); *C10M 2207/288* (2013.01); *C10M 2215/064* (2013.01); *C10M 2215/223* (2013.01); *C10M 2215/224* (2013.01); *C10M 2215/28* (2013.01); *C10M 2219/046* (2013.01); *C10M 2219/066* (2013.01); *C10M 2219/068* (2013.01); *C10M 2219/106* (2013.01); *C10M 2223/049* (2013.01); *C10M 2227/066* (2013.01); *C10M 2229/02* (2013.01); *C10N 2210/03* (2013.01); *C10N 2210/06* (2013.01); *C10N 2230/06* (2013.01); *C10N 2230/12* (2013.01); *C10N 2230/40* (2013.01); *C10N 2230/43* (2013.01); *C10N 2230/45* (2013.01); *C10N 2230/52* (2013.01); *C10N 2240/102* (2013.01); *C10N 2240/104* (2013.01); *C10N 2260/14* (2013.01)

(58) Field of Classification Search
CPC ..... C10M 2215/064; C10M 2227/061; C10M 2215/223; C10M 2219/068
USPC ..... 508/108, 156, 186
See application file for complete search history.

(56) References Cited

U.S. PATENT DOCUMENTS

| | | | | |
|---|---|---|---|---|
| 3,172,892 | A | 3/1965 | Le Suer et al. | |
| 3,219,666 | A | 11/1965 | Norman et al. | |
| 3,272,746 | A | 9/1966 | Le Suer et al. | |
| 3,313,727 | A | 4/1967 | Peeler et al. | |
| 3,819,521 | A | 6/1974 | Sims | |
| 3,853,772 | A | 12/1974 | Adams | |
| 3,907,601 | A | 9/1975 | Schaefer | |
| 3,997,454 | A | 12/1976 | Adams | |
| 4,089,790 | A | 5/1978 | Adams | |
| 4,259,194 | A | 3/1981 | deVries et al. | |
| 4,259,195 | A | 3/1981 | King et al. | |
| 4,265,773 | A | 5/1981 | deVries et al. | |
| 4,265,843 | A | 5/1981 | Dias et al. | |
| 4,283,295 | A | 8/1981 | deVries et al. | |
| 4,285,822 | A | 8/1981 | deVries et al. | |
| 4,584,115 | A | 4/1986 | Davis | |
| 4,648,985 | A | 3/1987 | Thorsell et al. | |
| 5,888,945 | A | 3/1999 | Stiefel et al. | |
| 6,010,987 | A | 1/2000 | Stiefel et al. | |
| 6,174,842 | B1 | 1/2001 | Gatto et al. | |
| 6,372,696 | B1 | 4/2002 | Tipton | |
| 6,534,450 | B1 | 3/2003 | Harrison et al. | |
| 6,737,387 | B2 | 5/2004 | Harrison et al. | |
| 8,076,275 | B2 | 12/2011 | Ruhe, Jr. et al. | |
| 2005/0153850 | A1 | 7/2005 | Nelson et al. | |
| 2070/0123437 | | 5/2007 | Boffa et al. | |
| 2010/0152072 | A1* | 6/2010 | Nelson | C10M 141/12 508/108 |
| 2014/0045737 | A1 | 2/2014 | Zhang et al. | |
| 2014/0179570 | A1* | 6/2014 | Loper | C10M 133/44 508/186 |
| 2017/0073608 | A1* | 3/2017 | Saccomando | C10M 135/14 |
| 2017/0260475 | A1 | 9/2017 | Zhang et al. | |

* cited by examiner

*Primary Examiner* — Vishal V Vasisth
(74) *Attorney, Agent, or Firm* — Ryan, Mason & Lewis LLP

(57) ABSTRACT

The present disclosure generally relates to a lubricating oil composition having a sulfur content of up to 0.4 wt. % and a sulfated ash content of up to 0.6 wt. %, as determined by ASTM D874, comprising: a major amount of base oil; at least 0.02 wt. % of triazole compound; less than about 1.3 wt. % of a diphenylamine antioxidant; and at least 900 ppm of molybdenum from a molybdenum containing compound; wherein the lubricating oil composition is essentially free of ZnDTP. Also provided are methods for reducing wear and copper corrosion in an engine which is equipped with a diesel particulate filter (DPF) or a gasoline particulate filter (GPF) after treatment device system.

20 Claims, No Drawings

ULTRA LOW ASH LUBRICATING OIL COMPOSITIONS

BACKGROUND OF THE DISCLOSURE

Exhaust after-treatment devices, equipped on internal combustion engines to comply with emission regulations, have proven to be sensitive to the combustion by products of the fuel and lubricant used in the engine. In addition, certain types of devices are sensitive to one or more of the following: (1) phosphorus coming from the lubricant, (2) sulfur coming from both fuel and lubricant, and (3) sulfated ash resulting from the combustion of fuel and lubricant. In order to ensure the durability of the different types of after-treatment devices, special lubricants are being developed that feature relatively low levels of, for example, sulfur, phosphorus, and sulfated ash.

Several challenges exist when formulating an automotive engine lubricant that is essentially free of Zinc Dialkyldithiophosphate (ZnDTP). ZnDTP is a versatile, anti-wear/anti-oxidant component that provides good wear and favorable oxidation protection under severe conditions. However, ZnDTPs comprise the elements zinc, sulfur and phosphorus which all have negative impact on exhaust after-treatment devices.

To compensate for the loss in antiwear and antioxidancy from ZnDTP, molybdenum-containing lubricating oil compositions were developed to advantageously provide high wear inhibition when used in an internal combustion engine while containing relatively low levels of sulfated ash content. However, a problem that was encountered when using high levels of molybdenum to compensate for the loss of ZnDTP was copper corrosion performance of the lubricating oil.

There is a need solve the problems described above. Original Engine Manufacturers have required passing the ASTM D6594 Test (HTCBT) and ASTM D130 test (Copper Strip Corrosion Test) to qualify lubricating oils for use in their engines. The challenge for ZnDTP-free oils is to develop a lubricating oil composition which maintains the wear performance of a conventional automotive lubricating oil, while at the same time preventing corrosion, and also ensures durability of the different types of after-treatment devices. The present inventors have developed a solution to this problem.

The inventors have discovered that not just any copper corrosion inhibitor provides sufficient copper corrosion performance in a high molybdenum containing and essentially ZnDTP-free oil. A specific chemistry is required. In addition, this chemistry enables the high wear inhibition performance to be achieved with the molybdenum-containing lubricating oil compositions of the present invention while also employing relatively low levels (or substantially free) of any phosphorus and zinc content.

SUMMARY OF THE DISCLOSURE

The present disclosure generally relates to a lubricating oil composition having a sulfur content of up to 0.4 wt. % and a sulfated ash content of up to 0.6 wt. % as determined by ASTM D874, comprising: a major amount of base oil; at least 0.02 wt. % of triazole compound; less than about 1.3 wt. % of a diphenylamine antioxidant; and at least 900 ppm of molybdenum from a molybdenum containing compound; wherein the lubricating oil composition is essentially free of ZnDTP.

Also provided are methods for reducing wear and copper corrosion in an engine comprising: lubricating the engine with a lubricating oil composition having a sulfur content of up to 0.4 wt. % and a sulfated ash content of up to 0.6 wt. % as determined by ASTM D874, comprising: a major amount of base oil; at least 0.02 wt. % of triazole compound; less than about 1.3 wt. % of a diphenylamine antioxidant; and at least 900 ppm of molybdenum from a molybdenum containing compound; wherein the lubricating oil composition is essentially free of ZnDTP, and wherein the engine is equipped with a diesel particulate filter (DPF) or a gasoline particulate filter (GPF) after treatment device system.

DETAILED DESCRIPTION OF THE DISCLOSURE

To facilitate the understanding of the subject matter disclosed herein, a number of terms, abbreviations or other shorthand as used herein are defined below. Any term, abbreviation or shorthand not defined is understood to have the ordinary meaning used by a skilled artisan contemporaneous with the submission of this application.

Definitions

In this specification, the following words and expressions, if and when used, have the meanings given below.

A "major amount" means in excess of 50 weight % of a composition.

A "minor amount" means less than 50 weight % of a composition, expressed in respect of the stated additive and in respect of the total mass of all the additives present in the composition, reckoned as active ingredient of the additive or additives.

"Active ingredients" or "actives" refers to additive material that is not diluent or solvent.

All percentages reported are weight % on an active ingredient basis (i.e., without regard to carrier or diluent oil) unless otherwise stated.

The abbreviation "ppm" means parts per million by weight, based on the total weight of the lubricating oil composition.

High temperature high shear (HTHS) viscosity at 150° C. was determined in accordance with ASTM D4683.

Kinematic viscosity at 100° C. ($KV_{100}$) was determined in accordance with ASTM D445.

Metal—The term "metal" refers to alkali metals, alkaline earth metals, or mixtures thereof.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated in a lubricating oil composition. For a further discussion of the terms oil soluble and dispersible, particularly "stably dispersible", see U.S. Pat. No. 4,320,019 which is expressly incorporated herein by reference for relevant teachings in this regard.

The term "sulfated ash" as used herein refers to the non-combustible residue resulting from detergents and metallic additives in lubricating oil. Sulfated ash may be determined using ASTM Test D874.

The term "Total Base Number" or "TBN" as used herein refers to the amount of base equivalent to milligrams of KOH in one gram of sample. Thus, higher TBN numbers reflect more alkaline products, and therefore a greater alkalinity. TBN was determined using ASTM D 2896 test.

Boron, calcium, magnesium, molybdenum, phosphorus, sulfur, and zinc contents were determined in accordance with ASTM D5185.

All ASTM standards referred to herein are the most current versions as of the filing date of the present application.

While the disclosure is susceptible to various modifications and alternative forms, specific embodiments thereof are herein described in detail. It should be understood, however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

Note that not all of the activities described in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described herein with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or other features that are inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the embodiments of the disclosure. This description should be read to include one or at least one and the singular also includes the plural, or vice versa, unless it is clear that it is meant otherwise. The term "averaged," when referring to a value, is intended to mean an average, a geometric mean, or a median value. Group numbers corresponding to columns within the Periodic Table of the elements use the "New Notation" convention as seen in the CRC Handbook of Chemistry and Physics, 81st Edition (2000-2001).

Unless otherwise defined, all technical and scientific terms used herein have the same meaning as commonly understood by one of ordinary skill in the art to which this disclosure belongs. The materials, methods, and examples are illustrative only and not intended to be limiting. To the extent not described herein, many details regarding specific materials and processing acts are conventional and may be found in textbooks and other sources within the lubricants as well as the oil and gas industries.

The specification and illustrations are not intended to serve as an exhaustive and comprehensive description of all the elements and features of formulations, compositions, apparatus and systems that use the structures or methods described herein. Separate embodiments may also be provided in combination in a single embodiment, and conversely, various features that are, for brevity, described in the context of a single embodiment, may also be provided separately or in any sub-combination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

The Triazole Compound

Any species containing the triazole moiety is useful in the composition according to the disclosure.

The compositions of the disclosure typically include the triazole from about 0.02 to about 1.0 percent by weight, but may also include from about 0.02 to 0.08, 0.02 to 0.07, 0.02 to 0.06, 0.02 to about 0.5 percent by weight of the triazole compound. In some embodiments, the composition of the invention contains no more than 1, 0.75, or even 0.5 percent by weight the triazole compound. In some embodiments, the composition of the invention contains at least 0.02, 0.03, 0.04, 0.05, 0.07, or even 0.1 percent by weight the triazole. The triazole compounds can be substituted with hydrocarbyl moieties.

The triazole of the present disclosure can have a MW of from about 70 to about 1000 g/mol, from about 70 to about 950 g/mol, from about 70 to about 900 g/mol, from about 70 to about 850 g/mol, from about 70 to about 800 g/mol, from about 70 to about 750 g/mol, from about 70 to about 700 g/mol, from about 70 to about 650 g/mol, from about 70 to about 600 g/mol, from about 70 to about 550 g/mol, or from about from about 70 to about 500 g/mol.

In an embodiment, the triazole of the present disclosure is one in which it does not include any active sulfur groups.

Alkyl and aryl derivatives of triazoles are preferred. Most preferred is the tolyltriazole. These can be substituted or unsubstituted.

As used herein, the terms "hydrocarbon", "hydrocarbyl" or "hydrocarbon based" mean that the moiety being described has predominantly hydrocarbon character within the context of this disclosure. These include moieties that are purely hydrocarbon in nature, that is, they contain only carbon and hydrogen. They can also include moieties containing substituents or atoms which do not alter the predominantly hydrocarbon character of the moiety. Such substituents can include halo, alkoxy, nitro, etc. These moieties also can contain hetero atoms. Suitable hetero atoms will be apparent to those skilled in the art and include, for example, sulfur, nitrogen, oxygen, and phosphorus. Therefore, while remaining predominantly hydrocarbon in character within the context of this invention, these moieties can contain atoms other than carbon present in a chain or ring otherwise composed of carbon atoms. For example, alkyl and aryl groups would be hydrocarbyl groups.

As an example, the triazole compound can be substituted with a substituted or unsubstituted aryl moiety comprising a single ring or multiple rings, for example covalently linked rings. Non-limiting examples of substituted aromatic moieties comprising covalently linked rings include biphenyl, 1,1'-binaphthyl, p,p'-bitolyl, biphenylenyl, and the like. As another example, the aryl moiety can comprise multiple fused rings. Non-limiting examples of aryl moieties comprising multiple fused rings include naphthyl, anthryl, pyrenyl, phenanthrenyl, phenalenyl, and the like. As a further example, the aryl moiety can comprise a single ring covalently linked to the triazole. Non-limiting examples of aryl moieties comprising a single ring covalently linked to the triazole include phenyl and the like. As another example, the aryl moiety can comprise a single ring fused to the triazole. Non-limiting examples of aryl moieties comprising a single ring fused to the triazole include benzotriazole and tolyltriazole.

The substituted triazole of the invention may be prepared by condensing a basic triazole via its acidic —NH group with an aldehyde and an amine. In some embodiments, the substituted triazole is the reaction product of a triazole, an aldehyde and an amine. Suitable triazoles that may be used to prepare the substituted triazole of the disclosure include triazole, alkyl substituted triazole, benzotriazole, tolyltriazole, or other aryltriazoles while suitable aldehydes include formaldehyde and reactive equivalents like formalin, while suitable amines include primary or secondary amines. In some embodiments, the amines are secondary amines and further are branched amines. In still further embodiments the amines are beta branched amines, for examples bis-2-ethylhexyl amine.

The triazole of the present disclosure may have one of the following structures:

(I)

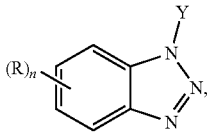

(II)

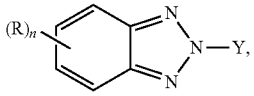

(III)

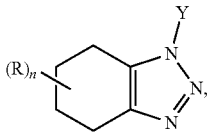

(IV)

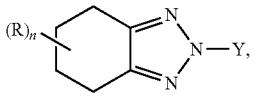

(V)

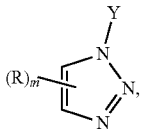

(VI)

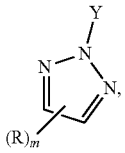

-continued (VII)

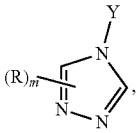

(VIII)

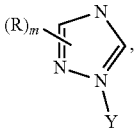

or a combination thereof; where, n is an integer from 0 to 4, m is 0, 1, or 2, R is a hydrocarbyl group and Y is —R' or —$(R^2)_p$—$NR^3R^3$ where —$R^1$ is a hydrocarbyl group, —$R^2$— is a hydrocarbylene group, p is 0 or 1, and each —$R^3$ is independently hydrogen or hydrocarbyl group.

In an example, the triazole may have the following structure (IX) or (X):

(IX)

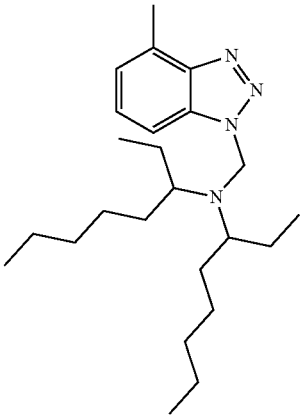

or (X)

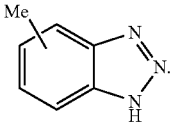

The Molybdenum Containing Compound

The organomolybdenum compound contains at least molybdenum, carbon and hydrogen atoms, but may also contain sulfur, phosphorus, nitrogen and/or oxygen atoms. Suitable organomolybdenum compounds include molybdenum dithiocarbamates, molybdenum dithiophosphates, and various organic molybdenum complexes such as molybdenum carboxylates, molybdenum esters, molybdenum amines, molybdenum amides, which can be obtained by reacting molybdenum oxide or ammonium molybdates with fats, glycerides or fatty acids, or fatty acid derivatives (e.g., esters, amines, amides). The term "fatty" means a carbon chain having 10 to 22 carbon atoms, typically a straight carbon chain.

Molybdate esters prepared by methods disclosed in U.S. Pat. Nos. 4,889,647 and 6,806,241 B2. A commercial example is MOLYVAN® 855 additive, which is manufactured by R. T. Vanderbilt Company, Inc.

Molybdenum dithiocarbamate (MoDTC) is an organomolybdenum compound represented by the following structure (XI):

(XI)

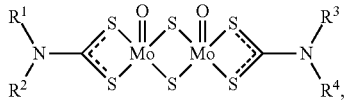

wherein $R^1$, $R^2$, $R^3$ and $R^4$ are independently of each other, linear or branched alkyl groups having from 4 to 18 carbon atoms (e.g., 8 to 13 carbon atoms).

Preparations of these compounds are well known in the literature and U.S. Pat. Nos. 3,356,702 and 4,098,705 are incorporated herein for reference. Commercial examples include MOLYVAN® 807, MOLYVAN® 822, and MOLYVAN® 2000, which are manufactured by R. T. Vanderbilt Company Inc., SAKURA-LUBE® 165 and SAKURA-LUBE® 515, which are manufactured by ADEKA CORPORATION and Naugalube® MolyFM which is manufactured by Chemtura Corporation.

Trinulcear molybdenum dialkyldithiocarbamates are also known in the art, as taught by U.S. Pat. Nos. 5,888,945 and 6,010,987, herein incorporated by reference. Trinuclear molybdenum compounds preferably those having the formulas Mo3S4(dtc)4 and Mo3S7(dtc)4 and mixtures thereof wherein dtc represents independently selected diorganodithiocarbamate ligands containing independently selected organo groups and wherein the ligands have a sufficient number of carbon atoms among all the organo groups of the compound's ligands are present to render the compound soluble or dispersible in the lubricating oil.

Molybdenum dithiophosphate (MoDTP) is an organomolybdenum compound represented by the following structure (XII):

(XII)

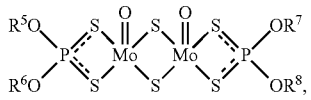

wherein $R^5$, $R^6$, $R^7$ and $R^8$ are independently of each other, linear or branched alkyl groups having from 4 to 18 carbon atoms (e.g., 8 to 13 carbon atoms).

Molybdenum carboxylates are described in U.S. Pat. RE 38,929, and U.S. Pat. No. 6,174,842 and thus are incorporated herein by reference. Molybdenum carboxylates can be derived from any oil soluble carboxylic acid. Typical carboxylic acids include naphthenic acid, 2-ethylhexanoic acid, and linolenic acid. Commercial sources of carboxylates produce from these particular acids are MOLYBDENUM NAP-ALL, MOLYBDENUM HEX-CEM, and MOLYBDENUM LIN-ALL respectively. Manufacturer of these products is OMG OM Group.

Ammonium molybdates are prepared by the acidibase reaction of acidic molybdenum source such as molybdenum trioxide, molybdic acid, and ammonium molybdate and ammonium thiomolybdates with oil-soluble amines and optionally in presence of sulfur sources such sulfur, inorganic sulfides and polysulfides, and carbons disulfide to name few. The preferred aminic compounds are polyamine dispersants that are commonly used engine oil compositions. Examples of such dispersants are succinimides and Mannich type. References to these preparations are U.S. Pat. Nos. 4,259,194, 4,259,195, 4,265,773, 4,265,843, 4,727,387, 4,283,295, and 4,285,822.

In one embodiment, the molybdenum amine is a molybdenum-succinimide complex. Suitable molybdenum-succinimide complexes are described, for example, in U.S. Pat. No. 8,076,275. These complexes are prepared by a process comprising reacting an acidic molybdenum compound with an alkyl or alkenyl succinimide of a polyamine of structure (XIII) or (XIV) or mixtures thereof:

(XIII)

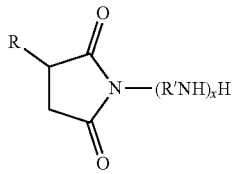

and (XIV)

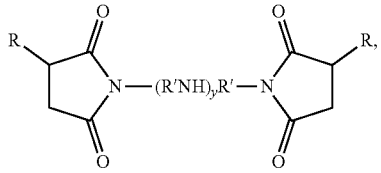

wherein R is a $C_{24}$ to $C_{350}$ (e.g., $C_{70}$ to $C_{128}$) alkyl or alkenyl group; R' is a straight or branched-chain alkylene group having 2 to 3 carbon atoms; x is 1 to 11; and y is 1 to 10.

The molybdenum compounds used to prepare the molybdenum-succinimide complex are acidic molybdenum compounds or salts of acidic molybdenum compounds. By "acidic" is meant that the molybdenum compounds will react with a basic nitrogen compound as measured by ASTM D664 or D2896. Generally, the acidic molybdenum compounds are hexavalent. Representative examples of suitable molybdenum compounds include molybdenum trioxide, molybdic acid, ammonium molybdate, sodium molybdate, potassium molybdate and other alkaline metal molybdates and other molybdenum salts such as hydrogen salts, (e.g., hydrogen sodium molybdate), MoOCl4, MoO2Br2, Mo2O3Cl6, and the like.

The succinimides that can be used to prepare the molybdenum-succinimide complex are disclosed in numerous references and are well known in the art. Certain fundamental types of succinimides and the related materials encompassed by the term of art "succinimide" are taught in U.S. Pat. Nos. 3,172,892; 3,219,666; and 3,272,746. The term "succinimide" is understood in the art to include many of the amide, imide, and amidine species which may also be formed. The predominant product however is a succinimide and this term has been generally accepted as meaning the product of a reaction of an alkyl or alkenyl substituted succinic acid or anhydride with a nitrogen-containing compound. Preferred succinimides are those prepared by reacting a polyisobutenyl succinic anhydride of about 70 to 128 carbon atoms with a polyalkylene polyamine selected from triethylenetetramine, tetraethylenepentamine, and mixtures thereof.

The molybdenum-succinimide complex may be post-treated with a sulfur source at a suitable pressure and a temperature not to exceed 120° C. to provide a sulfurized molybdenum-succinimide complex. The sulfurization step may be carried out for a period of from about 0.5 to 5 hours (e.g., 0.5 to 2 hours). Suitable sources of sulfur include elemental sulfur, hydrogen sulfide, phosphorus pentasulfide, organic polysulfides of formula R2Sx where R is hydrocarbyl (e.g., C1 to C10 alkyl) and x is at least 3, C1 to C10 mercaptans, inorganic sulfides and polysulfides, thioacetamide, and thiourea.

The lubricating oil compositions of the present invention will contain at least about 800 ppm, at least about 850 ppm, at least about 900 ppm, at least about 950 ppm, at least about 1000 ppm, at least about 1050 ppm, at least about 1100 ppm of molybdenum, based upon the total mass of the composition, provided from the one or more oil-soluble or dispersed oil-stable molybdenum-containing compounds. In one embodiment, the lubricating oil compositions of the present invention will contain about 800 ppm to about 2000 ppm, about 900 ppm to about 1500 ppm, about 900 ppm to about 1400 ppm, about 900 ppm to about 1300 ppm, about 900 ppm to about 1200 ppm, about 900 ppm to about 1100 ppm of molybdenum, based upon the total mass of the composition, provided from the one or more oil-soluble or dispersed oil-stable molybdenum-containing compounds.

In one embodiment, the oil-soluble or dispersed oil-stable molybdenum-containing compound will be present in the lubricating oil composition of the present invention such that the lubricating oil composition has a weight ratio of sulfur to molybdenum of less than or equal to about 4:1. In another embodiment, the lubricating oil composition has a weight ratio of sulfur to molybdenum of less than about 3:1. In yet another embodiment, the lubricating oil composition has a weight ratio of sulfur to molybdenum of about 0.5:1 to about 4:1. In another embodiment, the lubricating oil composition has a weight ratio of sulfur to molybdenum of about 1:1 to about 4:1. In still another embodiment, the lubricating oil composition has a weight ratio of sulfur to molybdenum of about 1:1 to about 3:1. In still yet another embodiment, the lubricating oil composition has a weight ratio of sulfur to molybdenum of about 1:1 to about 2.5:1.

Sulfur Containing Compound

In general, the level of sulfur in the lubricating oil compositions of the present invention is less than or equal to about 4000 ppm, based on the total weight of the lubricating oil composition, e.g., a level of sulfur of about 100 to 4000 ppm, 100 to 3000 ppm, 100 to 2500 ppm, 100 to 2400 ppm, 100 to 2300 ppm, 100 to 2200 ppm, 100 to 2100 ppm, 100 to 2000 ppm, 100 to 1900 ppm, 100 to 1800 ppm, 100 to 1700 ppm, 100 to 1600 ppm.

The sulfur content can be derived from elemental sulfur or a sulfur-containing compound. The sulfur or sulfur-containing compound may be intentionally added to the lubricating oil composition, or it may be present in the base oil or in one or more of the additives for the lubricating oil composition. In one embodiment, a major amount of the sulfur in the lubricating oil composition is derived from an active sulfur compound, i.e., an amount greater than 50%. By "active sulfur" is meant a sulfur compound which is antiwear active and preferably anticorrosive. The sulfur-containing compound may be an inorganic sulfur compound or an organic sulfur compound. The sulfur-containing compound may be a compound containing one or more of the groups: sulfamoyl, sulfenamoyl, sulfeno, sulfido, sulfinamoyl, sulfino, sulfinyl, sulfo, sulfonio, sulfonyl, sulfonyldioxy, sulfate, thio, thiocarbamoyl, thiocarbonyl, thiocarbonylamino, thiocarboxy, thiocyanato, thioformyl, thioxo, thioketone, thioaldehyde, thioester, and the like. The sulfur may also be present in a hetero group or compound which contains carbon atoms and sulfur atoms (and, optionally, other hetero atoms such as oxygen or nitrogen) in a chain or ring. Preferred sulfur-containing compounds include dihydrocarbyl sulfides and polysulfides such as alkyl or alkenyl sulfides and polysulfides, sulfurized fatty acids or esters thereof, ashless dithiophosphates, cyclic organo-sulfur compounds, polyisobutyl thiothione compounds, ashless dithiocarbamates and mixtures thereof.

Examples of the dihydrocarbyl sulfides or polysulfides include compounds represented by Formula XV:

$$R^9—S_b—R^{10} \quad \text{(XV)}$$

wherein $R^9$ and $R^{10}$ are the same or different and represent a $C_1$ to $C_{20}$ alkyl group, alkenyl group or a cyclic alkyl group, a $C_6$ to $C_{20}$ aryl group, a $C_7$ to $C_{20}$ alkyl aryl group, or a $C_7$ to $C_{20}$ aryl alkyl group; and b is an integer of 1 to 7. When each of $R^9$ and $R^{10}$ is an alkyl group, the compound is called an alkyl sulfide. Examples of the group represented by $R^9$ and $R^{10}$ in Formula VIII include methyl, ethyl, n-propyl, isopropyl, n-butyl, isobutyl, sec-butyl, tert-butyl, pentyl groups, hexyl groups, heptyl groups, octyl groups, nonyl groups, decyl groups, dodecyl groups, cyclohexyl, phenyl, naphthyl, tolyl, xylyl, benzyl, and phenethyl.

One class of suitable ashless dithiophosphates for use herein include those of the Formula XVI:

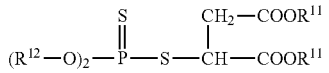

(XVI)

wherein $R^{11}$ and $R^{12}$ are independently an alkyl group having 3 to 8 carbon atoms (commercially available as VANLUBE® 7611M, from R.T. Vanderbilt Co., Inc.).

Another class of suitable ashless dithiophosphates for use herein include dithiophosphoric acid esters of carboxylic acid such as those commercially available as IRGALUBE® 63 from Ciba Geigy Corp.

Yet another class of suitable ashless dithiophosphates for use herein include triphenylphosphorothionates such as those commercially available as IRGALUBE® TPPT from Ciba Geigy Corp.

Suitable polyisobutyl thiothione compounds include those compounds represented by Formula XVII:

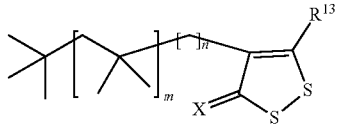

(XVII)

wherein $R^{13}$ is hydrogen or methyl; X is sulfur or oxygen; m is an integer from 1 to 9; and n is 0 or 1, and when n is 0 then $R^{13}$ is methyl, and when n is 1 then $R^{13}$ is hydrogen. Examples of these polyisobutyl thiothione compounds are disclosed in, for example, U.S. Patent Application Publication No. 20050153850, the contents of which are incorporated by reference herein.

In a preferred embodiment, a sulfur compound for use in the lubricating oil composition of the present invention is a bisdithiocarbamate compound of Formula XVIII:

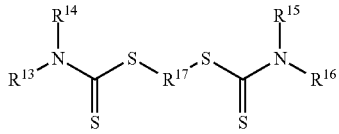

(XVIII)

wherein $R^{13}$, $R^{14}$, $R^{15}$, and $R^{16}$ are the same or different and are aliphatic hydrocarbyl groups having 1 to 13 carbon atoms and $R^{17}$ is an alkylene group having 1 to 8 carbon atoms. The bisdithiocarbamates of Formula XI are known compounds and described in U.S. Pat. No. 4,648,985, incorporated herein by reference. The aliphatic hydrocarbyl groups having 1 to 13 carbon atoms can be branched or straight chain alkyl groups having 1 to 13 carbon atoms. A preferred bisdithiocarbamate compound for use herein is methylenebis(dibutyldithiocarbamate) available commercially under the trademark Vanlube® 7723 (R. T. Vanderbilt Co., Inc.).

In one embodiment, the sulfur compound for use in the lubricating oil composition of the present invention is an ashless thiocarbamte compound as described in U.S. Patent Publication Nos. 20140045737 and 20170260475 which are both incorporated herein by reference.

In some embodiments, the lubricating oil compositions of the present invention are substantially free of any phosphorus content. In some embodiments, the level of phosphorous in the lubricating oil compositions of the present invention is from about 0.01 wt. % to about 0.12 wt. %, from about 0.01 wt. % to about 0.10 wt. %, from about 0.01 wt. % to about 0.08 wt. %, from about 0.01 wt. % to about 0.06 wt. %, based on the total weight of the lubricating oil composition. In one embodiment, the lubricating oil compositions of the present invention are substantially free of any zinc dialkyl dithiophosphate.

In one embodiment, the level of sulfated ash produced by the lubricating oil compositions of the present invention is less than or equal to about 0.60 wt. % as determined by ASTM D 874, e.g., a level of sulfated ash of from about 0.10 to about 0.60 wt. % as determined by ASTM D 874. In one embodiment, the level of sulfated ash produced by the lubricating oil compositions of the present invention is less than or equal to about 0.50 wt. % as determined by ASTM D 874, e.g., a level of sulfated ash of from about 0.10 to about 0.50 wt. % as determined by ASTM D 874. In one embodiment, the level of sulfated ash produced by the lubricating oil compositions of the present invention is less than or equal to about 0.40 wt. % as determined by ASTM D 874, e.g., a level of sulfated ash of from about 0.10 to about 0.40 wt. % as determined by ASTM D 874. In one embodiment, the level of sulfated ash produced by the lubricating oil compositions of the present invention is less than or equal to about 0.30 wt. % as determined by ASTM D 874, e.g., a level of sulfated ash of from about 0.10 to about 0.30 wt. % as determined by ASTM D 874.

The Diphenylamine Antioxidant

The lubricating oil compositions of the present invention can contain an amine antioxidant. In one embodiment, the antioxidant is a diphenylamine antioxidant. Examples of diphenyl amine antioxidants include monoalkylated diphenylamine, dialkylated diphenylamine trialkylated diphenylamine, and mixtures thereof. Some of these include butyldiphenylamine, butyldiphenylamine, oxtyldiphenylamine, di-octyldiphenylamine, nonyldiphenylamine, di-nonyldiphenylamine, t-butyl-t-octyldiphenyiamine, bis-nonylated diphenylamine, bis-octylated diphenylamine, and phenyl-α-naphthylamine, alkyl or arylalkyl substituted phenyl-α-naphthylamine, alkylated p-phenylene diamines, tetramethyl-diaminodiphenylamine and the like.

In some embodiments, the diphenylamine antioxidant is present at less than 1.3, less than 1.2, less than 1.0, less than 0.90 weight % based upon the total weight of the lubricating oil composition. In some embodiments, the diphenylamine antioxidant is present at from about 0.20 to about 1.30, from about 0.20 to about 1.20, from about 0.20 to about 1.10, from about 0.20 to about 1.00, from about 0.30 to about 0.90, from about 0.60 to about 0.90, from about 0.70 to about 0.90 weight % based upon the total weight of the lubricating oil composition. In one embodiment, the formulation is free of diphenylamine antioxidant.

The Boron Containing Compound

Representative examples of at least one oil-soluble or dispersed oil-stable boron-containing compound for use in the lubricating oil compositions of the present invention include a borated dispersant; a borated friction modifier; a dispersed alkali metal or a mixed alkali metal or an alkaline earth metal borate, a borated epoxide, a borate ester, a borated fatty amine, a borated amide, a borated sulfonate, a borated salicylate and the like, and mixtures thereof.

Examples of borated dispersants include, but are not limited to, borated ashless dispersants such as the borated polyalkenyl succinic anhydrides; borated non-nitrogen containing derivatives of a polyalkylene succinic anhydride; a borated basic nitrogen compound selected from the group consisting of succinimides, carboxylic acid amides, hydrocarbyl monoamines, hydrocarbyl polyamines, Mannich bases, phosphonoamides, thiophosphonamides and phosphoramides, thiazoles, e.g., 2,5-dimercapto-1,3,4-thiadiazoles, mercaptobenzothiazoles and derivatives thereof, triazoles, e.g., alkyltriazoles and benzotriazoles, copolymers which contain a carboxylate ester with one or more additional polar function, including amine, amide, imine, imide, hydroxyl, carboxyl, and the like, e.g., products prepared by copolymerization of long chain alkyl acrylates or methacrylates with monomers of the above function; and the like and mixtures thereof. A preferred borated dispersant is a succinimide derivative of boron such as, for example, a borated polyisobutenyl succinimide.

Examples of borated friction modifiers include, but are not limited to, borated fatty epoxides, borated alkoxylated fatty amines, borated glycerol esters and the like and mixtures thereof.

The hydrated particulate alkali metal borates are well known in the art and are available commercially. Representative examples of hydrated particulate alkali metal borates and methods of manufacture include those disclosed in, e.g., U.S. Pat. Nos. 3,313,727; 3,819,521; 3,853,772; 3,907,601; 3,997,454; 4,089,790; 6,737,387 and 6,534,450, the contents of which are incorporated herein by reference. The hydrated alkali metal borates can be represented by the following Formula: $M_2O.mB_2O_3.nH_2O$ where M is an alkali metal of atomic number in the range of about 11 to about 19, e.g., sodium and potassium; m is a number from about 2.5 to about 4.5 (both whole and fractional); and n is a number from about 1.0 to about 4.8. Preferred are the hydrated sodium borates. The hydrated borate particles generally have a mean particle size of less than about 1 micron.

Examples of borated epoxides include borated epoxides obtained from the reaction product of one or more of the boron compounds with at least one epoxide. Suitable boron compounds include boron oxide, boron oxide hydrate, boron trioxide, boron trifluoride, boron tribromide, boron trichloride, boron acids such as boronic acid, boric acid, tetraboric acid and metaboric acid, boron amides and various esters of boron acids. The epoxide is generally an aliphatic epoxide having from about 8 to about 30 carbon atoms and preferably from about 10 to about 24 carbon atoms and more preferably from about 12 to about 20 carbon atoms. Suitable aliphatic epoxides include dodecene oxide, hexadecene oxide and the like and mixtures thereof. Mixtures of epoxides may also be used, for instance commercial mixtures of epoxides having from about 14 to about 16 carbon atoms or from about 14 to about 18 carbon atoms. The borated epoxides are generally known and described in, for example, U.S. Pat. No. 4,584,115.

Examples of borate esters include those borate esters obtained by reacting one or more of the boron compounds disclosed above with one or more alcohols of suitable oleophilicity. Typically, the alcohols will contain from 6 to about 30 carbons and preferably from 8 to about 24 carbon atoms. The methods of making such borate esters are well known in the art. The borate esters can also be borated phospholipids. Representative examples of borate esters include those having the structures set forth in Formulae XIX-XXI:

(XIX)

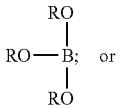

(XX)

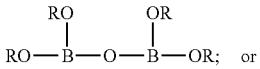

(XXI)

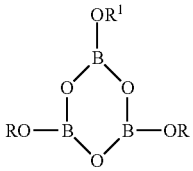

wherein each R is independently a $C_1$-$C_{12}$ straight or branched alkyl group and $R^1$ is hydrogen or a $C_1$-$C_{12}$ straight or branched alkyl group.

Examples of borated fatty amines include borated fatty amines obtained by reacting one or more of the boron compounds disclosed above with one or more of fatty amines, e.g., an amine having from about fourteen to about eighteen carbon atoms. The borated fatty amines may be prepared by reacting the amine with the boron compound at a temperature in the range of from about 50 to about 300° C., and preferably from about 100 to about 250° C., and at a ratio from about 3:1 to about 1:3 equivalents of amine to equivalents of boron compound.

Examples of borated amides include borated amides obtained from the reaction product of a linear or branched, saturated or unsaturated monovalent aliphatic acid having 8 to about 22 carbon atoms, urea, and polyalkylenepolyamine with a boric acid compound and the like and mixtures thereof.

Examples of borated sulfonates include borated alkaline earth metal sulfonates obtained by (a) reacting in the presence of a hydrocarbon solvent (i) at least one of an oil-soluble sulfonic acid or alkaline earth sulfonate salt or mixtures thereof; (ii) at least one source of an alkaline earth metal; (iii) at least one source of boron, and (iv) from 0 to less than 10 mole percent, relative to the source of boron, of an overbasing acid, other than the source of boron; and (b) heating the reaction product of (a) to a temperature above the distillation temperature of the hydrocarbon solvent to distill the hydrocarbon solvent and water from the reaction. Suitable borated alkaline earth metal sulfonates include those disclosed in, for example, U.S. Patent Application Publication No. 20070123437, the contents of which are incorporated by reference herein.

Examples of borated salicylates include borated alkaline earth metal salicylates obtained by (a) reacting in the presence of a hydrocarbon solvent (i) at least one of an oil-soluble salicylic acid or alkaline earth salicylate salt or mixtures thereof; (ii) at least one source of an alkaline earth metal; (iii) at least one source of boron, and (iv) from 0 to less than 10 mole percent, relative to the source of boron, of an overbasing acid, other than the source of boron; and (b) heating the reaction product of (a) to a temperature above the distillation temperature of the hydrocarbon solvent to distill the hydrocarbon solvent and water from the reaction.

The lubricating oil compositions of the present invention will contain greater than about 400 ppm of boron, based upon the total mass of the composition, provided from the one or more oil-soluble or dispersed oil-stable boron-containing compounds. In one embodiment, the lubricating oil compositions of the present invention will contain at least about 500 ppm of boron, based upon the total mass of the composition, provided from the one or more oil-soluble or dispersed oil-stable boron-containing compounds. In another embodiment, the lubricating oil compositions of the present invention will contain at least about 600 ppm of boron, based upon the total mass of the composition, provided from the one or more oil-soluble or dispersed oil-stable boron-containing compounds. In yet another embodiment, the lubricating oil compositions of the present invention will contain at least about 700 ppm of boron, based upon the total mass of the composition, provided from the one or more oil-soluble or dispersed oil-stable boron-containing compounds. In other embodiments, the lubricating oil compositions of the present invention will contain from about 400 ppm to no more than about 2000 ppm, about 500 ppm to no more than about 1500 ppm, about 600 ppm to no more than about 1500 ppm, about 600 ppm to no more than about 1200 ppm, about 600 ppm to no more than about 1000 ppm, about 600 ppm to no more than about 900 ppm, about 700 ppm to no more than about 900 ppm, about 750 ppm to no more than about 900 ppm of boron, based upon the total mass of the composition, provided from the one or more oil-soluble or dispersed oil-stable boron-containing compounds.

Other Lubricating Oil Additives

The lubricating oil compositions of the present disclosure may also contain other conventional additives that can impart or improve any desirable property of the lubricating oil composition in which these additives are dispersed or dissolved. Any additive known to a person of ordinary skill in the art may be used in the lubricating oil compositions disclosed herein. Some suitable additives have been described in Mortier et al., "Chemistry and Technology of Lubricants", 2nd Edition, London, Springer, (1996); and Leslie R. Rudnick, "Lubricant Additives: Chemistry and Applications", New York, Marcel Dekker (2003), both of which are incorporated herein by reference. For example, the lubricating oil compositions can be blended with antioxidants, anti-wear agents, metal detergents, rust inhibitors, dehazing agents, demulsifying agents, metal deactivating agents, friction modifiers, pour point depressants, antifoaming agents, co-solvents, corrosion-inhibitors, ashless dispersants, multifunctional agents, dyes, extreme pressure agents and the like and mixtures thereof. A variety of the additives are known and commercially available. These additives, or their analogous compounds, can be employed for the preparation of the lubricating oil compositions of the disclosure by the usual blending procedures.

The lubricating oil composition of the present invention can contain one or more detergents. Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts. A large amount of a metal base may be incorporated by reacting excess metal compound (e.g., an oxide or hydroxide) with an acidic gas (e.g., carbon dioxide).

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium.

The lubricating oil composition of the present invention can contain one or more friction modifiers that can lower the friction between moving parts. Any friction modifier known by a person of ordinary skill in the art may be used in the lubricating oil composition. Non-limiting examples of suitable friction modifiers include fatty carboxylic acids; derivatives (e.g., alcohol, esters, borated esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphonic acids; mono-, di- or tri-alkyl substituted amines; mono- or di-alkyl substituted amides and combinations thereof. In some embodiments examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a C4 to C75, or a C6 to C24, or a C6 to C20, fatty acid ester and a nitrogen-containing compound selected from the group consisting of ammonia, and an alkanolamine and the like and mixtures thereof. The amount of the friction modifier may vary from about 0.01 wt. % to about 10 wt. %, from about 0.05 wt. % to about 5 wt. %, or from about 0.1 wt. % to about 3 wt. %, based on the total weight of the lubricating oil composition.

The lubricating oil composition of the invention can contain additional organic oxidation inhibitors in an amount of 0.1-3 wt. %. In addition to the diarylamine above, the oxidation inhibitor can be a hindered phenol oxidation inhibitor.

Examples of the hindered phenol oxidation inhibitors include 2,6-di-t-butyl-p-cresol, 4,4'-methylenebis(2,6-di-t-butylphenol), 4,4'-methylenebis(6-t-butyl-o-cresol), 4,4'-isopropylidenebis(2,6-di-t-butylphenol), 4,4'-bis(2,6-di-t-butylphenol), 2,2'-methylenebis(4-methyl-6-t-butylphenol), 4,4'-thiobis(2-methyl-6-t-butylphenol), 2,2-thio-diethylenebis [3-(3,5-di-t-butyl-4-hydroxyphenyl)propionate], octyl 3-(3,5-di-t-butyl-4-hydroxyphenyl)propionate, octadecyl 3-(3,5-di-t-butyl-4-hydroxyphenyl)propionate, and octyl 3-(3,54-butyl-4-hydroxy-3-methylphenyl)propionate, and commercial products such as, but not limited to, Irganox L135® (BASF), Naugalube 531® (Chemtura), and Ethanox 376® (SI Group).

Oil of Lubricating Viscosity

The oil of lubricating viscosity (sometimes referred to as "base stock" or "base oil") is the primary liquid constituent of a lubricant, into which additives and possibly other oils are blended, for example to produce a final lubricant (or lubricant composition). A base oil is useful for making concentrates as well as for making lubricating oil compositions therefrom, and may be selected from natural and synthetic lubricating oils and combinations thereof.

Natural oils include animal and vegetable oils, liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes); alkylbenzenes (e.g., dodecylbenzenes, tetradecylbenzenes, dinonylbenzenes, di(2-ethylhexyl)benzenes, Alkylated Naphthalene; polyphenols (e.g., biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g., malonic acid, alkyl malonic acids, alkenyl malonic acids, succinic acid, alkyl succinic acids and alkenyl succinic acids, maleic acid, fumaric acid, azelaic acid, suberic acid, sebacic acid, adipic acid, linoleic acid dimer, phthalic acid) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

The base oil may be derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized; hydrocracked and hydroisomerized; dewaxed; or hydroisomerized and dewaxed; using processes known to those skilled in the art.

Unrefined, refined and re-refined oils can be used in the present lubricating oil composition. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art.

Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Hence, the base oil which may be used to make the present lubricating oil composition may be selected from any of the base oils in Groups I-V as specified in the American Petroleum Institute (API) Base Oil Interchangeability Guidelines (API Publication 1509). Such base oil groups are summarized in Table 1 below:

TABLE 1

| | Base Oil Properties | | |
|---|---|---|---|
| Group[a] | Saturates[b], wt. % | Sulfur[c], wt. % | Viscosity Index[d] |
| Group I | <90 and/or | >0.03 | 80 to <120 |
| Group II | ≥90 | ≤0.03 | 80 to <120 |
| Group III | ≥90 | ≤0.03 | ≥120 |
| Group IV | Polyalphaolefins (PAOs) | | |
| Group V | All other base stocks not included in Groups I, II, III or IV | | |

[a]Groups I-III are mineral oil base stocks.
[b]Determined in accordance with ASTM D2007.
[c]Determined in accordance with ASTM D2622, ASTM D3120, ASTM D4294 or ASTM D4927.
[d]Determined in accordance with ASTM D2270.

Base oils suitable for use herein are any of the variety corresponding to API Group II, Group III, Group IV, and Group V oils and combinations thereof, preferably the Group III to Group V oils due to their exceptional volatility, stability, viscometric and cleanliness features.

The oil of lubricating viscosity for use in the lubricating oil compositions of this disclosure, also referred to as a base oil, is typically present in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered oil of lubricating viscosity used in formulating lubricating oil compositions for any and all such applications, e.g., engine oils, marine cylinder oils, functional fluids such as hydraulic oils, gear oils, transmission fluids, etc. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof. The topology of viscosity modifier could include, but is not limited to, linear, branched, hyperbranched, star, or comb topology.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C.). Generally, individually the base oils used as engine oils will have a kinematic viscosity range at 100° C. of about 2 cSt to about 30 cSt, preferably about 2 cSt to about 20 cSt, preferably about 2 cSt to about 18 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-8, 0W-12, 0W-16, 0W-20, 0W-26, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, 15W-40, 30, 40 and the like.

Suitably, the present lubricating oil composition may have a total base number (TBN) of 4 to 12 mg KOH/g (e.g., 5 to 12 mg KOH/g, 6 to 12 mg KOH/g, 6 to 10 mg KOH/g, 6 to 8 mg KOH/g).

In general, the concentration of each of the additives in the lubricating oil composition, when used, may range from about 0.001 wt. % to about 20 wt. %, from about 0.01 wt. % to about 15 wt. %, or from about 0.1 wt. % to about 10 wt. %, from about 0.005 wt. % to about 5 wt. %, or from about 0.1 wt. % to about 2.5 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

In the preparation of lubricating oil formulations, it is common practice to introduce the additives in the form of 10 to 80 wt. % active ingredient concentrates in hydrocarbon oil, e.g. mineral lubricating oil, or other suitable solvent.

Usually these concentrates may be diluted with 3 to 100, e.g., 5 to 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend.

Processes of Preparing Lubricating Oil Compositions

The lubricating oil compositions disclosed herein can be prepared by any method known to a person of ordinary skill in the art for making lubricating oils. In some embodiments, the base oil can be blended or mixed with the additive compounds described herein. Any mixing or dispersing equipment known to a person of ordinary skill in the art may be used for blending, mixing or solubilizing the ingredients. The blending, mixing or solubilizing may be carried out with a blender, an agitator, a disperser, a mixer (e.g., planetary mixers and double planetary mixers), a homogenizer (e.g., Gaulin homogenizers and Rannie homogenizers), a mill (e.g., colloid mill, ball mill and sand mill) or any other mixing or dispersing equipment known in the art.

In some embodiments, the lubricating oil composition disclosed herein may be suitable for use as motor oils (that is, engine oils or crankcase oils), in a compression ignited engine or in a spark-ignited internal combustion engine, particularly a direct injected, boosted, engine. In addition to being particularly effective for improving copper corrosion and reducing wear performance for heavy duty compression ignited engines equipped with an after-treatment device such as a diesel particulate filter (DPF), the lubricating oil composition can be particularly effective at improving copper corrosion and reducing wear performance for a spark ignited engine equipped with a gasoline particulate filter (GPF).

The following examples are presented to exemplify embodiments of the disclosure but are not intended to limit the disclosure to the specific embodiments set forth. Unless indicated to the contrary, all parts and percentages are by weight. All numerical values are approximate. When numerical ranges are given, it should be understood that embodiments outside the stated ranges may still fall within the scope of the disclosure. Specific details described in each example should not be construed as necessary features of the disclosure.

It will be understood that various modifications may be made to the embodiments disclosed herein. Therefore, the above description should not be construed as limiting, but merely as exemplifications of preferred embodiments. For example, the functions described above and implemented as the best mode for operating the present disclosure are for illustration purposes only. Other arrangements and methods may be implemented by those skilled in the art without departing from the scope and spirit of this disclosure. Moreover, those skilled in the art will envision other modifications within the scope and spirit of the claims appended hereto.

EXAMPLES

The following examples are intended for illustrative purposes only and do not limit in any way the scope of the present disclosure. Unless otherwise indicated, all wt. % are given on an additive basis which includes an appropriate amount of diluent oil.

Formulation A

A low phosphorus lubricating oil composition was prepared by blending together the following components to obtain a SAE 10W-30 viscosity grade formulation:

(1) 760 ppm, in terms of boron content, of a combination of a borated dispersant (5.2 wt. % in the finished oil based on the additive), a hydrated potassium borate (0.556 wt. % in the finished oil) and a borated sulfonate (3 mmol/kg in the finished oil) having a total base number (TBN) of 160 on an additive basis.

(2) 1200 ppm, in terms of molybdenum content, of a molybdenum succinimide complex.

(3) 2.6 wt. % of a dispersant.

(4) 14 mmol/kg total of one or more detergents.

(5) 1.31 wt. % of an alkylated diphenylamine antioxidant.

(6) 1 wt. % of a hindered phenol antioxidant.

(7) 0.7 wt % of an ashless dithiocarbamate (8) 0.5 wt. % of a pour point depressant.

(9) 3.0 wt. % of a dispersant viscosity index improver.

(10) 10 ppm, in terms of silicon content, of a foam inhibitor.

(11) The remainder was diluent oil composed of approximately 70 wt. % of a Group III base oil and approximately 30 wt. % of a Group II base oil.

Corrosion Inhibitor A

Copper corrosion inhibitor (metal deactivator) A was IRGAMET® 39, a tolyltriazole derivative available from BASF. Its chemical name is 1-[bis(2-ethylhexy)aminomethyl]-4-methylbenzotriazole.

Corrosion Inhibitor B

Copper corrosion inhibitor B was DURAPHOS® TLP, a phoshite available from Rhodia Group. Its chemical name is trilauryl phosphite.

Corrosion Inhibitor C

Copper corrosion inhibitor C was HITEC® 4313, an ashless dialkyl thiadiazole available from Afton Chemical. Its chemical name is 2,5-bis(octyldisulfanyl)-1,3,4-thiadiazole.

Corrosion Inhibitor D

Copper corrosion inhibitor D was HITEC® 4312, an ashless dialkyl thiadiazole derivative available from Afton Chemical. Its chemical name is 2,5-dimercapto-1,3,4-thiadiazole derivative.

Corrosion Inhibitor E

Copper corrosion inhibitor E was Vanlube® RI-A, an alkyl succinic acid half acid ester derivative available from R.T. Vanderbilt.

Corrosion Inhibitor F

Copper corrosion inhibitor F was Amine O, a N-β-hydroxyethyl oleyl imidazoline available from BASF.

Corrosion Inhibitor G

Copper corrosion inhibitor G was Kemguard® CI-4083, a hydroxyethyl imidazoline concentrate available from Kemira.

Corrosion Inhibitor H

Copper corrosion inhibitor H was Cobratec® TT-100, a mixture of 5-methyl and 4-methyl 1H-benzotriazole (i.e., tolyltriazole) available from PMC Specialties Group.

Corrosion Inhibitor I

Copper corrosion inhibitor I was Vanlube® 601E, $C_{12}$-$C_{14}$ tert-alkyl compounds with 2(3H)-benzothiazolethione available from R.T. Vanderbilt.

Example 1

A lubricating oil was blended similar to formulation A with the exception that 0.85 wt. % of a diphenylamine antioxidant and 0.42 wt. % of an ashless dithiocarbamate was used and 0.02 wt. % of a corrosion inhibitor A was added.

Example 2

A lubricating oil was blended similar to formulation A with the exception that 0.85 wt. % of a diphenylamine antioxidant and 0.42 wt. % of an ashless dithiocarbamate was used and 0.03 wt. % of a corrosion inhibitor A was added.

Example 3

A lubricating oil was blended similar to formulation A with the exception that 0.85 wt. % of a diphenylamine antioxidant and 0.42 wt. % of an ashless dithiocarbamate was used and 0.04 wt. % of a corrosion inhibitor A was added.

Example 4

A lubricating oil was blended similar to formulation A with the exception that 0.85 wt. % of a diphenylamine antioxidant and 0.42 wt. % of an ashless dithiocarbamate was used and 0.05 wt. % of a corrosion inhibitor A was added.

Example 5

A lubricating oil was blended similar to formulation A with the exception that 1000 ppm, in terms of molybdenum content, of a molybdenum succinimide complex and 0.42 wt. % of an ashless dithiocarbamate was used and 0.02 wt. % of a corrosion inhibitor A was added.

Example 6

A lubricating oil was blended similar to formulation A with the exception that 0.85 wt. % of a diphenylamine antioxidant and 0.42 wt. % of an ashless dithiocarbamate was used and 0.07 wt. % of a corrosion inhibitor A was added.

Example 7

A lubricating oil was blended similar to formulation A with the exception that 0.85 wt. % of a diphenylamine antioxidant and 0.42 wt. % of an ashless dithiocarbamate was used and 0.10 wt. % of a corrosion inhibitor A was added.

Example 8

A lubricating oil was blended similar to formulation A with the exception that 0.85 wt. % of a diphenylamine antioxidant and 0.42 wt. % of an ashless dithiocarbamate was used and 0.15 wt. % of a corrosion inhibitor A was added.

Example 9

A lubricating oil was blended similar to formulation A with the exception that 0.75 wt. % of a diphenylamine antioxidant was used and 0.05 wt. % of a corrosion inhibitor A was added.

Example 10

A lubricating oil was blended similar to formulation A with the exception that 0.75 wt. % of a diphenylamine antioxidant and 0.75 wt. % of a hydrated potassium borate was used and 0.05 wt. % of a corrosion inhibitor A was added. This increased the boron in the formulation to 890 ppm from 760 ppm.

Example 11

A lubricating oil was blended similar to formulation A with the exception that 0.75 wt. % of a diphenylamine antioxidant and 0.42 wt. % of an ashless dithiocarbamate was used and 0.05 wt. % of a corrosion inhibitor A was added. This caused the sulfur in the formulation to drop to 1600 ppm from 2400 ppm.

Example 12

A lubricating oil was blended similar to formulation A with the exception that 0.75 wt. % of a diphenylamine antioxidant, 0.75 wt. % of a hydrated potassium borate, 0.42 wt. % of an ashless dithiocarbamate was used and 0.05 wt. % of a corrosion inhibitor A was added. This caused the boron in the formulation to increase to 890 ppm from 760 ppm and the sulfur in the formulation to drop to 1600 ppm from 2400 ppm.

Example 13

A lubricating oil was blended similar to formulation A with the exception that 0.75 wt. % of a diphenylamine antioxidant and 0.42 wt. % of an ashless dithiocarbamate was used and 0.05 wt. % of a corrosion inhibitor H was added. This caused the sulfur in the formulation to drop to 1600 ppm from 2400 ppm.

Comparative Example 1

Formulation A was replicated.

Comparative Example 2

A lubricating oil was blended similar to formulation A with the exception that 0.02 wt. % of a corrosion inhibitor A was added.

Comparative Example 3

A lubricating oil was blended similar to formulation A with the exception that 0.03 wt. % of a corrosion inhibitor A was added.

Comparative Example 4

A lubricating oil was blended similar to formulation A with the exception that 0.04 wt. % of a corrosion inhibitor A was added.

Comparative Example 5

A lubricating oil was blended similar to formulation A with the exception that 0.05 wt. % of a corrosion inhibitor A was added.

Comparative Example 6

A lubricating oil was blended similar to formulation A with the exception that 0.5 wt. % of a corrosion inhibitor B was added.

Comparative Example 7

A lubricating oil was blended similar to formulation A with the exception that 0.15 wt. % of a corrosion inhibitor C was added.

Comparative Example 8

A lubricating oil was blended similar to formulation A with the exception that 0.05 wt. % of a corrosion inhibitor D was added.

Comparative Example 9

A lubricating oil was blended similar to formulation A with the exception that 0.05 wt. % of a corrosion inhibitor E was added.

Comparative Example 10

A lubricating oil was blended similar to formulation A with the exception that 0.05 wt. % of a corrosion inhibitor F was added.

Comparative Example 11

A lubricating oil was blended similar to formulation A with the exception that 0.05 wt. % of a corrosion inhibitor G was added.

Comparative Example 12

A lubricating oil was blended similar to formulation A with the exception that 0.05 wt. % of a corrosion inhibitor I was added.

ASTM D6594 HTCBT (High Temperature Corrosion Bench Test)

The ASTM D6594 HTCBT test is used to test diesel engine lubricants to determine their tendency to corrode various metals, specifically alloys of lead and copper commonly used in cam followers and bearings. Four metal specimens of copper (Cu), lead (Pb), tin (Sn) and phosphor bronze are immersed in a measured amount of engine oil. The oil, at an elevated temperature (170° C.), is blown with air (5 l/h) for a period of time (168 h). When the test is completed, the copper specimen and the stressed oil are examined to detect corrosion and corrosion products, respectively. The concentrations of copper, lead, and tin in the new oil and stressed oil and the respective changes in metal concentrations are reported. To be a pass, the concentration of lead should not exceed 120 ppm and copper should not exceed 20 ppm. A copy of this test method can be obtained from ASTM International at 100 Barr Harbor Drive, PO Box 0700, West Conshohocken, Pa. 19428-2959 and is herein incorporated for all purposes. Results of the HTCHT are given below in Tables 2 and 3.

Copper Strip Corrosion Test—ASTM D130

Crude petroleum contains sulfur compounds, most of which are removed during refining. However, of the sulfur compounds remaining in the petroleum product, some can have a corroding action on various metals and this corrosivity is not necessarily related directly to the total sulfur content. The effect can vary according to the chemical types of sulfur compounds present. The copper strip corrosion test is designed to assess the relative degree of corrosivity of a petroleum product. In this test, a polished copper strip is immersed in a specific volume of the sample being tested and heated under conditions of temperature and time that are specific to the class of material being tested. At the end of the heating period, the copper strip is removed, washed and the color and tarnish level assessed against the ASTM Copper Strip Corrosion Standard summarized below (Table 2).

TABLE 2

ASTM D130-04: Copper Strip Classifications

| Classification | Designation | Description[1] |
|---|---|---|
| Freshly polished strip[2] | | |
| 1 | Slight tarnish | a. Light orange<br>b. Dark Orange |
| 2 | Moderate tarnish | a Claret red<br>b. Lavender<br>c. Multicolored with lavender blue or silver or both, overlaid on claret red<br>d. Silvery<br>e. Brassy or Gold |
| 3 | Dark tarnish | a. Magenta overcast on brassy strip<br>b. Multicolored with red and green showing (peacock), but no gray |
| 4 | Corrosion | a. Transparent black, dark gray or brown with peacock green barely showing<br>b. Glossy or jet black |

[1]The ASTM Copper Strip Corrosion Standard is a colored reproduction of strips characteristic of these descriptions.

[2]The freshly polished strip is included in the series only as an indication of the appearance of a properly polished strip before a test run; it is not possible to duplicate this appearance after a test even with a completely noncorrosive sample.

The corrosion property of Examples 1-13 and Comparative Examples 1-12 were evaluated in the both the HTCBT and Copper Strip Corrosion Test. These results are given in Tables 3 to 7. It is evident that Examples 1-13 provided superior performance against copper corrosion as compared to Comparative Examples 1-12. For the purposes of this study, numbers under 30 for copper are extraordinary good.

TABLE 3

Effect of Triazole Corrosion Inhibitor Treat Rate

| | Comp. Ex. 1 | Comp. Ex. 2 | Comp. Ex. 3 | Comp. Ex. 4 | Comp. Ex. 5 |
|---|---|---|---|---|---|
| Cu (ppm) | 250 | 33 | 30 | 37 | 37 |
| Pb (ppm) | 2 | 1 | 1 | 1 | 2 |
| Sn (ppm) | 3 | 0 | 0 | 2 | 0 |
| Cu Strip rating | 4b | 3b | 3b | 3a | 3b |

*Results are the average of two runs

TABLE 4

Effect of Amount of Diphenylamine Antioxidant, Sulfur Reduction, and Amount of Triazole Corrosion Inhibitor

| | Ex. 1 | Ex. 2 | Ex. 3 | Ex. 4 |
|---|---|---|---|---|
| Cu (ppm) | 24 | 22 | 22 | 21 |
| Pb (ppm) | 0 | 0 | 0 | 0 |
| Sn (ppm) | 2 | 3 | 3 | 3 |
| Cu Strip rating | 3b | 3b | 3b | 3b |

*Results are the average of two runs

TABLE 5

| Effect of Other Corrosion Inhibitors | | | | | | | | |
|---|---|---|---|---|---|---|---|---|
| | Comp. Ex. 6 | Comp. Ex. 7 | Comp. Ex. 8 | Comp. Ex. 9 | Comp. Ex. 10 | Comp. Ex. 11 | Comp. Ex. 12 | Ex. 13 |
| Cu (ppm) | 365 | 231 | 198 | 239 | 265 | 280 | 400 | 20 |
| Pb (ppm) | 0 | 1 | 1 | 0 | 0 | 0 | 21 | 0 |
| Sn (ppm) | 3 | 3 | 2 | 0 | 0 | 0 | 1 | 1 |
| Cu Strip rating | 4b | 4b | 4a | 4a | 4a | 4a | 3b | 3b |

*Results are the average of two runs

TABLE 6

| Effect of Molybdenum Reduction | |
|---|---|
| | Ex. 5 |
| Cu (ppm) | 25 |
| Pb (ppm) | 0 |
| Sn (ppm) | 1 |
| Cu Strip rating | 3b |

*Results are the average of two runs

TABLE 7

| Amount of Diphenylamine Antioxidant, Active Sulfur, Amount of Triazole Corrosion Inhibitor, and Amount of Boron | | | | | | | |
|---|---|---|---|---|---|---|---|
| | Ex. 6 | Ex. 7 | Ex. 8 | Ex. 9 | Ex. 10 | Ex. 11 | Ex. 12 |
| Cu (ppm) | 20 | 20 | 18 | 23 | 23 | 18 | 19 |
| Pb (ppm) | 0 | 0 | 0 | 0 | 0 | 0 | 0 |
| 0Sn (ppm) | 1 | 1 | 1 | 4 | 2 | 1 | 0 |
| Cu Strip rating | 2e | 2e | 3a | 3a | 3a | 3b | 3b |

*Results are the average of two runs

What is claimed is:

1. A lubricating oil composition having a sulfur content of up to 0.4 wt. % and a sulfated ash content of up to 0.6 wt. % as determined by ASTM D874, comprising:

a. a major amount of base oil;

b. at least 0.02 wt. % to about 1.0 wt. %, based on the total weight of the lubricating oil composition, of a triazole compound represented by the following structure:

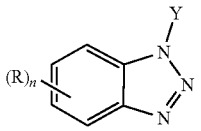

wherein n is 1, R is a hydrocarbyl group and Y is hydrogen, —$R^1$ or —$(R^2)_p$—$NR^3R^3$ where —$R^1$ is a hydrocarbyl group, —$R^2$ is a hydrocarbylene group, p is 0 or 1, and each —$R^3$ is independently hydrogen or hydrocarbyl group, and wherein the triazole compound has a molecular weight of about 70 to about 1000 g/mol; and;

c. about 0.20 to 1.3 wt. %, based on the total weight of the lubricating oil composition, of a diphenylamine antioxidant;

d. at least 900 ppm of molybdenum from a molybdenum containing compound; and e. about 100 to 4000 ppm of sulfur derived from an ashless sulfur containing wear inhibitor;

wherein the lubricating oil composition is essentially free of ZnDTP.

2. The composition of claim 1, wherein composition further comprises an oil soluble or oil dispersible boron-containing compound.

3. The composition of claim 2, wherein the boron-containing compound is present in an amount of at least about 500 ppm of boron, based upon the total weight of the composition.

4. The composition of claim 3, wherein the boron-containing compound is present in an amount from about 500 ppm to about 1500 ppm of boron, based upon the total weight of the composition.

5. The composition of claim 1, wherein the sulfur content is from about 0.01 to about 0.4 wt. %, based upon the total weight of the composition.

6. The composition of claim 1, wherein the molybdenum containing compound is present in an amount of from about 900 to 1500 ppm of molybdenum, based upon the total weight of the composition.

7. The composition of claim 1, wherein the composition has a weight ratio of sulfur to molybdenum of less than or equal to 4:1.

8. The composition of claim 7, wherein the composition has a weight ratio of sulfur to molybdenum of from 0.5:1 to 4:1.

9. The composition of claim 1, wherein the triazole compound is present at from about 0.02 wt. % to about 0.08 wt. %, based on the total weight of the lubricating oil composition.

10. The composition of claim 1, wherein the sulfated ash is present at from about 0.01 wt. % to about 0.60 wt. %, based on the total weight of the lubricating oil composition.

11. The composition of claim 1, wherein the diphenylamine antioxidant is present at from about 0.30 wt. % to about 1.30 wt. %, based on the total weight of the lubricating oil composition.

12. The composition of claim 1, wherein phosphorous is present at is from about 0.01 wt. % to about 0.12 wt. %, based on the total weight of the lubricating oil composition.

13. A method for improving copper corrosion performance in an engine comprising:

(i) lubricating said engine with a lubricating oil composition having a sulfur content of up to 0.4 wt. % and a sulfated ash content of up to 0.6 wt. % as determined by ASTM D874, comprising:

a. a major amount of base oil;

b. at least 0.02 wt. % to about 1.0 wt. %, based on the total weight of the lubricating oil composition, of triazole compound represented by the following structure:

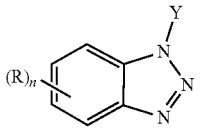

wherein n is 1, R is a hydrocarbyl group and Y is hydrogen, —$R^1$ or —$(R^2)_p$—$NR^3R^3$ where —$R^1$ is a hydrocarbyl group, —$R^2$— is a hydrocarbylene group, p is 0 or 1, and each —$R^3$ is independently hydrogen or hydrocarbyl group, and wherein the triazole compound has a molecular weight of about 70 to about 1000 g/mol;

c. about 0.20 to 1.3 wt. %, based on the total weight of the lubricating oil composition, of a diphenylamine antioxidant;

d. at least 900 ppm of molybdenum from a molybdenum containing compound; and e. about 100 to 4000 ppm of sulfur derived from an ashless sulfur containing wear inhibitor;

wherein the lubricating oil composition is essentially free of ZnDTP, and (ii) operating said engine, wherein the engine is equipped with a diesel particulate filter (DPF) after treatment device system.

14. A method for improving copper corrosion performance in an engine comprising:

(i) lubricating said engine with a lubricating oil composition having a sulfur content of up to 0.4 wt. % and a sulfated ash content of up to 0.6 wt. % as determined by ASTM D874, comprising:

e. a major amount of base oil;

f. at least 0.02 wt. % to about 1.0 wt. %, based on the total weight of the lubricating oil composition, of triazole compound represented by the following structure:

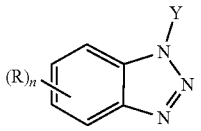

wherein n is 1, R is a hydrocarbyl group and Y is hydrogen, —$R^1$ or —$(R^2)_p$—$NR^3R^3$ where —$R^1$ is a hydrocarbyl group, —$R^2$— is a hydrocarbylene group, p is 0 or 1, and each —$R^3$ is independently hydrogen or hydrocarbyl group, and wherein the triazole compound has a molecular weight of about 70 to about 1000 g/mol;

g. about 0.20 to 1.3 wt. %, based on the total weight of the lubricating oil composition, of a diphenylamine antioxidant;

h. at least 900 ppm of molybdenum from a molybdenum containing compound; and i. about 100 to 4000 ppm of sulfur derived from an ashless sulfur containing wear inhibitor;

wherein the lubricating oil composition is essentially free of ZnDTP, and (ii) operating said engine, wherein the engine is equipped with a gasoline particulate filter (GPF) after treatment device system.

15. A method for reducing wear while at the same time improving copper corrosion performance in an engine comprising:

(i) lubricating said engine with a lubricating oil composition having a sulfur content of up to 0.4 wt. % and a sulfated ash content of up to 0.6 wt. % as determined by ASTM D874, comprising:

a. a major amount of base oil;

b. at least 0.02 wt. % to about 1.0 wt. %, based on the total weight of the lubricating oil composition, of triazole compound represented by the following structure:

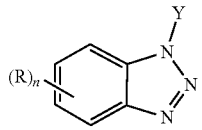

wherein n is 1, R is a hydrocarbyl group and Y is hydrogen, —$R^1$ or —$(R^2)_p$—$NR^3R^3$ where —$R^1$ is a hydrocarbyl group, —$R^2$— is a hydrocarbylene group, p is 0 or 1, and each —$R^3$ is independently hydrogen or hydrocarbyl group, and wherein the triazole compound has a molecular weight of about 70 to about 1000 g/mol;

c. about 0.20 to 1.3 wt. %, based on the total weight of the lubricating oil composition, of a diphenylamine antioxidant;

d. at least 900 ppm of molybdenum from a molybdenum containing compound; and e. about 100 to 4000 ppm of sulfur derived from an ashless sulfur containing wear inhibitor;

wherein the lubricating oil composition is essentially free of ZnDTP, and (ii) operating said engine, wherein the engine is equipped with a diesel particulate filter (DPF) after treatment device system.

16. A method for reducing wear while at the same time improving copper corrosion performance in an engine comprising:

(i) lubricating said engine with a lubricating oil composition of having a sulfur content of up to 0.4 wt. % and a sulfated ash content of up to 0.6 wt. % as determined by ASTM D874, comprising:

m. a major amount of base oil;

n. at least 0.02 wt. % to about 1.0 wt. %, based on the total weight of the lubricating oil composition, of triazole compound represented by the following structure:

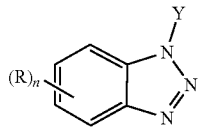

wherein n is 1, R is a hydrocarbyl group and Y is hydrogen, —$R^1$ or —$(R^2)_p$—$NR^3R^3$ where —$R^1$ is a hydrocarbyl group, —$R^2$— is a hydrocarbylene group, p is 0 or 1, and each —$R^3$ is independently hydrogen or hydrocarbyl group, and wherein the triazole compound has a molecular weight of about 70 to about 1000 g/mol;

o. about 0.20 to 1.3 wt. %, based on the total weight of the lubricating oil composition, of a diphenylamine antioxidant;

p. at least 900 ppm of molybdenum from a molybdenum containing compound; and q. about 100 to 4000 ppm of sulfur derived from an ashless sulfur containing wear inhibitor;

wherein the lubricating oil composition is essentially free of ZnDTP, and (ii) operating said engine, wherein the engine is equipped with a gasoline particulate filter (GPF) after treatment device system.

17. The method of claim 13, wherein the lubricating oil composition further comprises an oil soluble or oil dispersible boron-containing compound.

18. The method of claim 14, wherein the lubricating oil composition further comprises an oil soluble or oil dispersible boron-containing compound.

19. The method of claim 15, wherein the lubricating oil composition further comprises an oil soluble or oil dispersible boron-containing compound.

20. The method of claim 16, wherein the lubricating oil composition further comprises an oil soluble or oil dispersible boron-containing compound.

* * * * *